US007693461B2

(12) United States Patent
Lee et al.

(10) Patent No.: US 7,693,461 B2
(45) Date of Patent: Apr. 6, 2010

(54) SYSTEM AND METHOD FOR MINIMIZING RESIDUAL CHARGE EFFECTS IN A PRINTING DEVICE

(75) Inventors: Michael H. Lee, Palo Alto, CA (US); Boaz Tagansky, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 701 days.

(21) Appl. No.: 11/325,000

(22) Filed: Jan. 3, 2006

(65) Prior Publication Data

US 2007/0154245 A1 Jul. 5, 2007

(51) Int. Cl.
*G03G 15/10* (2006.01)

(52) U.S. Cl. ..... 399/239; 399/240

(58) Field of Classification Search ..... 399/237, 399/239, 240, 249, 57, 264, 273, 283; 430/117.3, 430/117.31

See application file for complete search history.

(56) References Cited

U.S. PATENT DOCUMENTS

| | | | | |
|---|---|---|---|---|
| 5,923,929 | A | 7/1999 | Ben Avraham et al. | |
| 6,038,421 | A * | 3/2000 | Yoshino et al. | 399/239 |
| 6,775,501 | B2 * | 8/2004 | Kim | 399/237 |
| 6,776,099 | B1 | 8/2004 | Landa et al. | |
| 6,868,246 | B2 * | 3/2005 | Takeuchi et al. | 399/237 |
| 7,085,521 | B2 * | 8/2006 | Park | 399/237 |
| 7,151,906 | B2 * | 12/2006 | Chou et al. | 399/237 |
| 2003/0138271 | A1 | 7/2003 | Cho et al. | |
| 2006/0153596 | A1 * | 7/2006 | Gilan et al. | 399/237 |
| 2006/0291907 | A1 * | 12/2006 | Tanner et al. | 399/237 |

FOREIGN PATENT DOCUMENTS

| | | | |
|---|---|---|---|
| JP | 08 328388 | A | 12/1996 |
| JP | 10 274885 | A | 10/1998 |
| JP | 10274885 | A * | 10/1998 |
| JP | 2006 243047 | A | 9/2006 |

* cited by examiner

*Primary Examiner*—Robert Beatty

(57) ABSTRACT

A development unit for a printing device is described. An equalizing element is provided to minimize residual charges which cause ghosting. The equalizing element can, for example, be a roller or a blade positioned downstream of a cleaning nip between the cleaning roller and the development roller and charged to an electric potential which is substantially the same as an electric potential of the development roller. The equalizing element can alternatively, or in addition to being charged to perform equalization, operate to aid in charge residual charge dissipation on the development roller by blocking developer from reaching the development roller downstream of the cleaning roller.

22 Claims, 6 Drawing Sheets

SYSTEM AND METHOD FOR MINIMIZING RESIDUAL CHARGE EFFECTS IN A PRINTING DEVICE

BACKGROUND

The present invention relates generally to printing devices and methods and, more particularly, to developing units used in printing devices, e.g., printers.

Printing devices play many roles in today's technology society. Local printers, for example, are coupled directly to (or via a network of some type) most personal computers to provide hard copy output capabilities. Larger scale printers, e.g., digital printing presses, are used commercially to print everything from brochures, mass mailings to newspapers, etc.

One type of printing technology is multicolor electrostatic printing. This printing technology has been used in various commercial products, such as digital printing presses. Parts of an electrostatic printing device are shown in FIG. 1. Therein, an image receptor, e.g., an organic photoreceptor, is provided on a drum 10 and driven by a motor (not shown) to rotate in the direction of the arrow. The drum 10 rotates the image receptor past a charging device 12, e.g., a corona device or other charging apparatus, which charges the image receptor on drum 10 to a predetermined voltage level. An image to be reproduced is generated on the charged image receptor using a suitable imaging device 14, e.g., a laser, which operates to discharge a portion of the charge which was placed on the image receptor by charging device 12. This results in the image receptor of drum 10 having an image portion and a background portion which are defined electrically by areas of different electric potential.

The latent image on the image receptor can be developed in multiple ways. Typical laser printers use toner powders as the developer. For devices with a liquid toning system, the developer is commonly referred to as ink or liquid toner. As used herein, the term "developer" includes toner powders, inks, liquid toners and the like. For liquid developers the image is usually formed by electrophoresis of charged ink particles onto the discharged regions of the photoreceptor. In an alternative liquid toning embodiment, an elastic developer roller 16 may be first coated with liquid developer particles by electrophoresis. Then the roller is urged against the imaged photoreceptor on drum 10 at the nip between drum 10 and development roller 16, the region proximate this nip also referred to herein as the "development zone". Once the developer is provided to the image receptor on drum 10, the electrostatic latent image is developed and ready for transfer, via transfer roller 20 to a substrate 22, e.g., paper, carried by roller 24. Alternatively, the developed image can go directly from the image receptor to the substrate.

One advantage associated with using the development roller 16 to transfer developer to the image receptor on drum 10, rather than applying the developer directly to the drum 10 downstream of the imaging device 14, is that the operating speed of the system can be increased while still maintaining a sufficiently thick developer layer. However, use of the development roller has also resulted in certain challenges, including ghost images. An example is shown in FIG. 2 for a print made using a system similar to that of FIG. 1. Therein, a page 26 was printed entirely in cyan (which is shown in the Figure as grey) except for a rectangular patch 28 in which the cyan was omitted. There are two ghosting related problems with the printed page 26. First, the cyan in the lower portion of page 26 was printed with a lower density (lighter color) than the cyan in the upper portion of the page, despite the fact that the intended color density for the entire page was the same.

Second, a ghosted rectangular patch 29 appeared symmetrically in the lower portion of the page 26 as a rectangular patch of cyan having a density which is higher than the surrounding region (the same density as in the upper portion of page 26). The upper portion of the page 26 has a length which corresponds to the circumference of the developer roller 16, with the developer roller 16 and imaged photoreceptor drum 10 moving at substantially the same surface speed. These circumstances indicate that the ghosting problems are associated with the development roller 16. More specifically, the ghosting problems illustrated in FIG. 2 may be associated with insufficient developer roller conductivity.

The development roller 16 is usually made of an elastomeric polymer, such as polyurethane, doped with a conductive agent. These non-insulating elastomers are only moderately conductive, having a resistivity of around $10^6$ ohm-cm or higher. While metals are much more conductive, they are typically not appropriate materials for the development roller 16 since good contact with the inelastic photoreceptor on drum 10 can only be ensured with an elastic roller. One solution to this problem is to increase the concentration of the conductive particles in the developer roller 16 to increase its conductivity. However, this solution may have drawbacks because higher concentrations may negatively impact the mechanical and chemical properties of the development roller. Accordingly, it would be desirable to provide systems and methods for printing which avoid the afore-described problems and drawbacks.

SUMMARY

According to one exemplary embodiment of the present invention, a method for minimizing residual charge effects in a printing device includes the steps of applying an electric potential to a development roller to attract developer to the development roller, rotating the development roller in a development zone of the printing device to form an image, cleaning residual developer from the development roller after the development roller has passed the development zone, and equalizing a charge density on the development roller after the cleaning.

BRIEF DESCRIPTION OF THE DRAWINGS

The accompanying drawings, which are incorporated in and constitute a part of the specification, illustrate an embodiment of the invention and, together with the description, explain the invention. In the drawings.

DETAILED DESCRIPTION

The following description of the exemplary embodiments of the present invention refers to the accompanying drawings.

The same reference numbers in different drawings identify the same or similar elements. The following detailed description does not limit the invention. Instead, the scope of the invention is defined by the appended claims.

Figure 3:
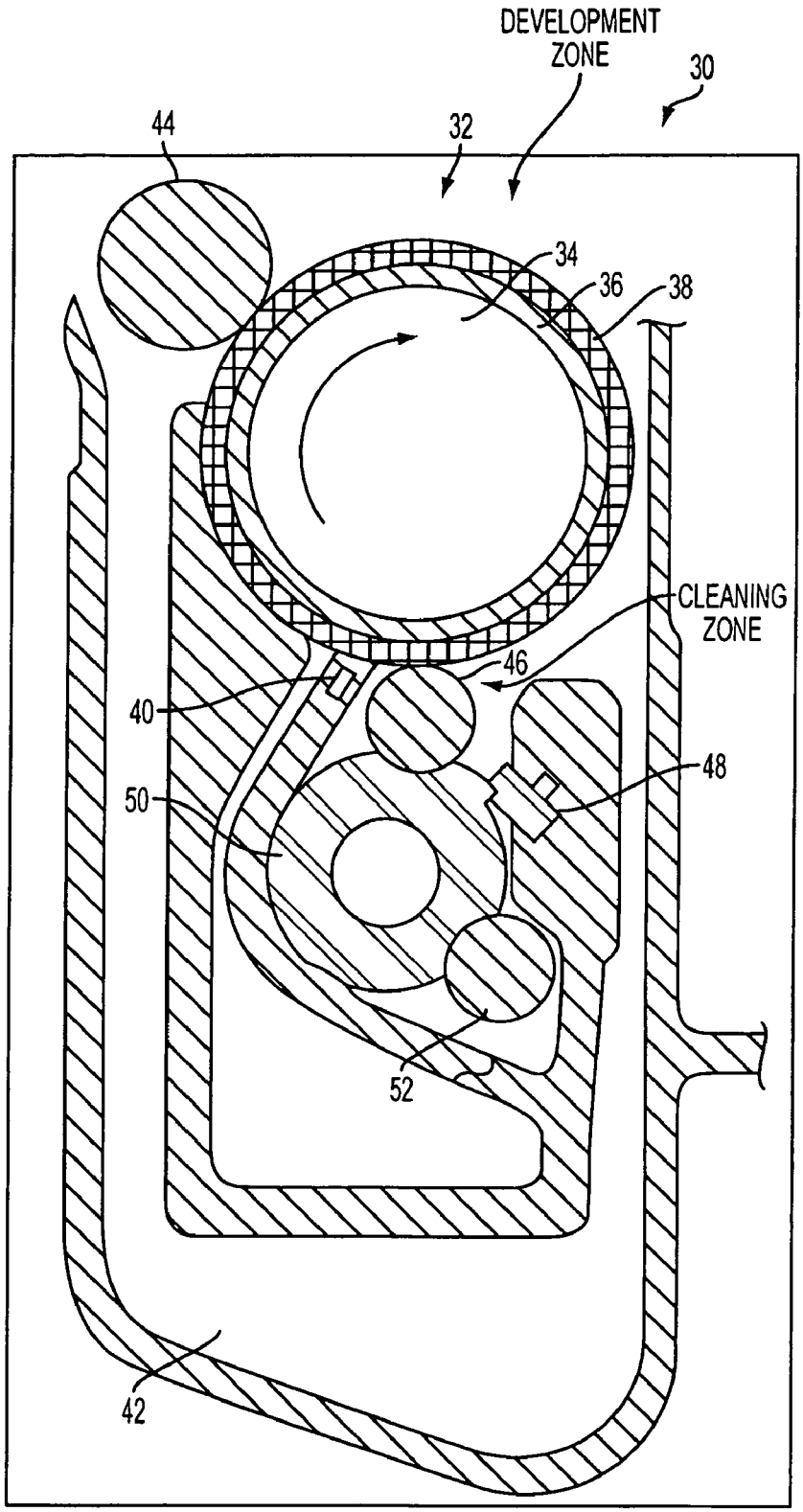
FIG. 3 is a side sectional view of an exemplary development unit in which the present invention can be implemented.

In order to provide some context for exemplary embodiments of the present invention, a sectional view of a development unit 30 in which the present invention can be implemented is illustrated in FIG. 3. Those skilled in the art will appreciate that the present invention can be implemented in other types of development units and printing devices. Therein, the development roller 32 has an inner core 34 covered by a conductive, elastomeric layer 38. An electrode 40 held at a first electric potential, in conjunction with a second (different) electric potential at which the development roller 32 is held, creates an electric field which results in developer from the developer repository 42 being deposited on the elastomeric layer 38 of development roller 32 at a desired thickness via electrophoresis. Simply as an example, the electrode 40 can be charged to −1500V while the development roller 32 can be held at −450V to establish such an electric field, although different voltages may also be used.

The deposited developer layer is then compressed by a squeegee roller 44 before being presented to the photoconductive drum (not shown in this figure) at the development zone. The developer is transferred to the photoconductive drum in the development zone to develop the latent electrostatic image carried thereon, as described above. This results in the photoconductive drum having imaged regions (where the developer is present) and non-imaged regions (where the developer is not present). The development roller 32, rotating in the direction of the illustrated arrow in FIG. 3, transfers any developer which remains after passing through the development zone to the cleaning roller 46 for removal. In this purely exemplary embodiment, cleaning roller 46 can be held at −250V to transfer the developer electrically from the developer roller 32 to the cleaning roller 46 at the cleaning nip between development roller 32 and cleaning roller 46, the region proximate this cleaning nip also referred to herein as the "cleaning zone". In some embodiments, the developer is removed from the cleaning roller 46 by a wiper blade 48 and sponge roller 50 and returned to the developer repository 42 by a squeezer roller 52.

Figure 1:
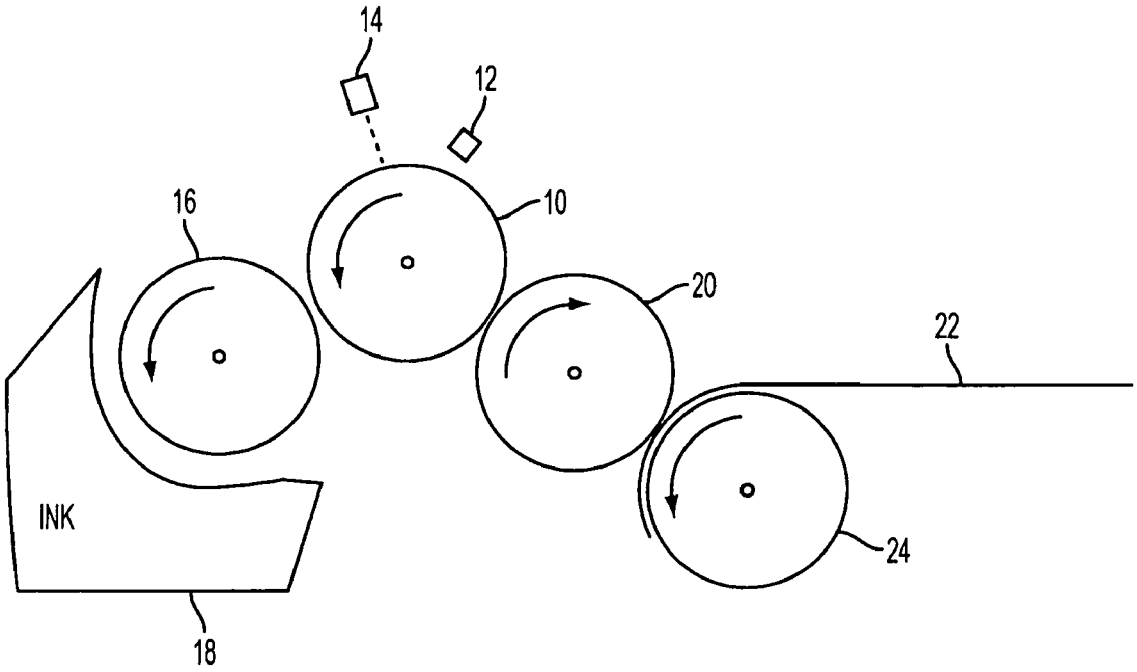
FIG. 1 shows an exemplary electrostatic printing device in which the present invention can be implemented.
Figure 2:
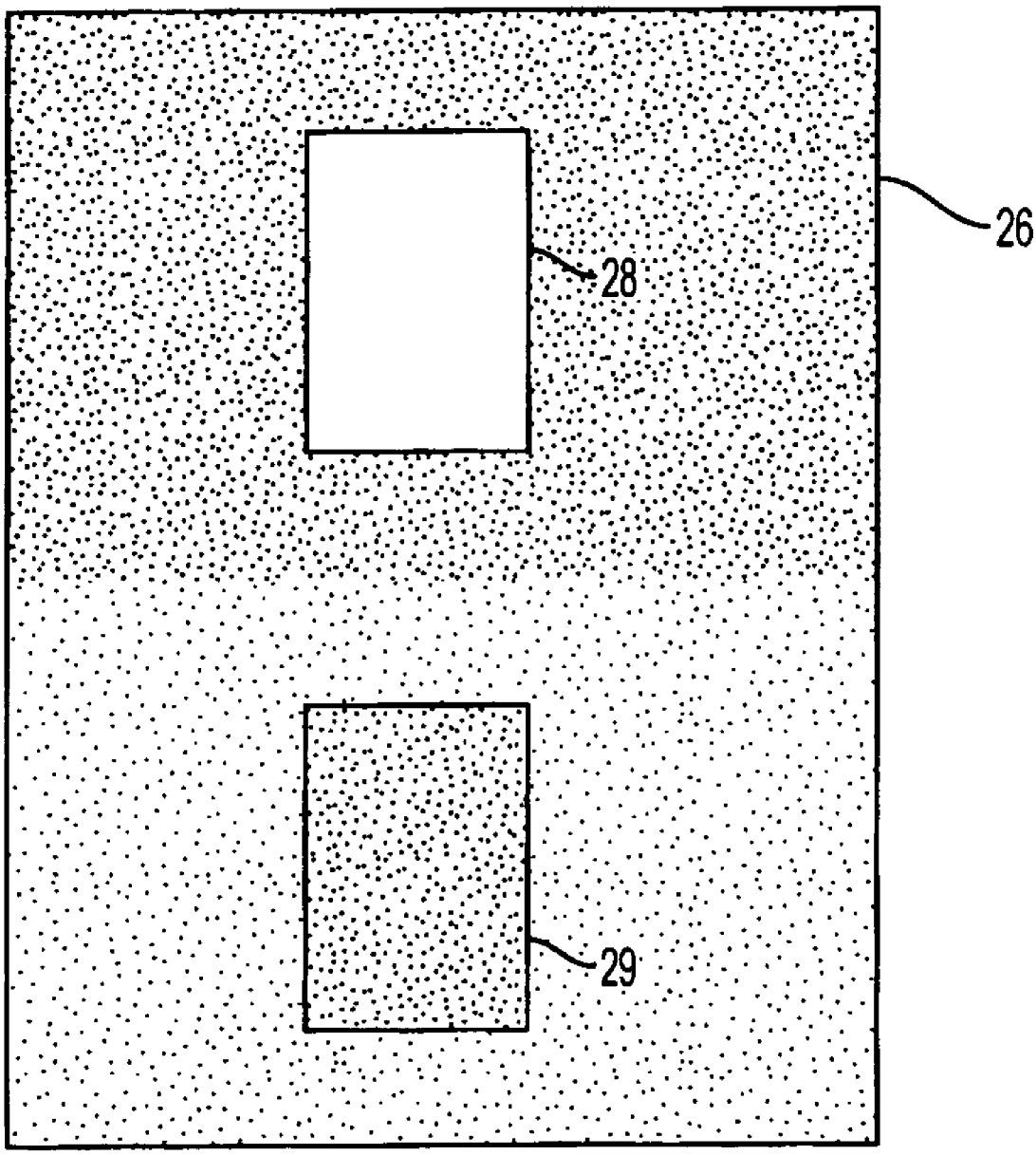
FIG. 2 illustrates a page printed using an electrostatic printing device with ghosting effects.

The ghosting problems discussed above and illustrated in FIG. 2 are caused, at least in part, by a residual electrical charge which is retained on the development roller 32 as it rotates past the cleaning roller 46. More specifically, the residual electrical charge is formed as a by-product of the electric field used to remove the residual developer from the development roller 32. Since the voltage between the developer roller 32 and the cleaning roller 46 is fixed during operation, the electric field established in the cleaning zone depends on the thickness of the developer layer between the rollers 32 and 46, which can vary. On the portions of the development roller 32 which correspond to the imaged regions of photoconductive drum 10, the residual developer layer carried into the cleaning zone is relatively small, since most of the developer was transferred to form the latent image. By way of contrast, on those portions of the development roller 32 which correspond to the non-imaged regions of photoconductive drum 10, the residual developer layer carried into the cleaning zone is the same as the thickness of the initial developer layer applied to the developer roller 32—since essentially no developer in these regions is transferred to form an image. The large difference in residual developer layer thicknesses associated with the imaged and non-imaged areas results in a large difference in charge between these regions on the developer roller 32 in the cleaning zone. To the extent that this charge difference is not dissipated before the development roller 32 returns to the region proximate electrode 40, the developer thickness that is subsequently formed on the developer roller 32 in the region of electrode 40 is affected by a residual electrical image created by this charge difference (i.e., the ghosting image).

Figure 4:
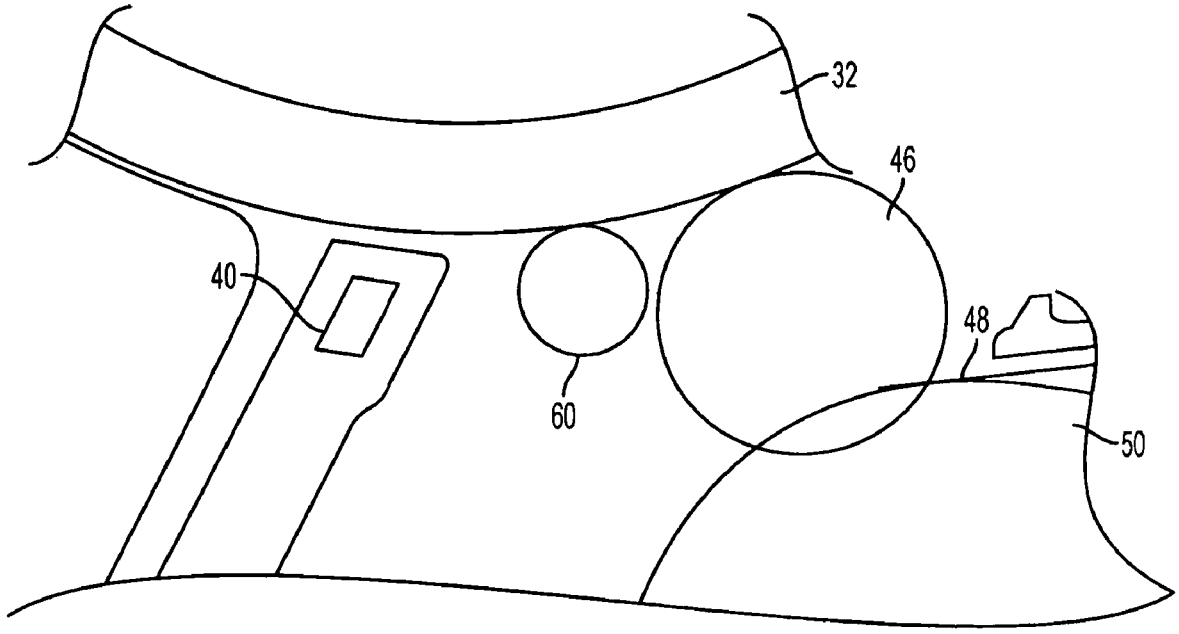
FIG. 4 is a magnified view of a portion of the development unit of FIG. 3 also including an equalizing element according to an exemplary embodiment of the present invention.

According to exemplary embodiments of the present invention, this residual electrical image is equalized by providing, for example, an equalizing element 60 that contacts the development roller 32 downstream of the cleaning roller 46 as shown in FIG. 4. As used herein, the terms "equalizing", "equalize" and "equalized" refer to making the charge density across a surface substantially uniform, in this case across the surface of development roller 32. Therein, a magnified view of a portion of the development unit 30 is shown with the addition of the equalizing element 60, otherwise the same reference numerals are used as in FIG. 3. In the example of FIG. 4, the equalizing element is a metal roller 60 which is held at the same (or substantially the same) voltage as the development roller 32. This has the effect of making the charge density across the surface of the development roller 32 substantially uniform, to reduce or eliminate the ghosting effects described above.

A number of different types and implementations of equalizing element 60 are possible according to the present invention. For example, the equalizing element 60 need not be a roller, but could be any element in contact with, or in close proximity to, the development roller 32, e.g., a fixed, metal blade. Likewise, the equalizing element need not be made of metal, but can be made of any conductive material. Also, the equalizing element 60 can have a potential which differs from that of the development roller 32 as long as the voltage is set such that the developer does not develop on the equalizing element 60 or substantially on the development roller 32 before the development roller 32 enters the region of electrode 40.

The desired dissipation of residual charges on the development roller 32 may be retarded if residual developer reaches the surface of the developer roller 32 downstream of the cleaning zone. In addition, residual developer (not completely removed by the cleaning zone) that still retains residual charges from operations in the cleaning zone may result in development of the ghost pattern described above. Thus, the equalizing element 60 may also (or as an alternative to the electrical equalization described above) perform the function of substantially blocking developer from entering the area downstream of the cleaning zone. Locating the equalizing element 60 close to the cleaning roller 46 enables the equalizing element 60 to provide this developer blocking function. Assuming the developer is blocked from reaching the surface of development roller 32 in the region immediately downstream of the cleaning roller 46, the charge distribution on the developer roller 32's surface dissipates over time with the rate which is dependent on roller conductivity. If the dissipation rate is sufficiently fast, the charge may be substantially eliminated as the development roller 32 reaches the equalizing element 60. Hence, instead of dissipating residual charge by providing an equalizing voltage, element 60 dissipates residual charge in this exemplary embodiment by blocking developer from roller 32. In that case the equalizing element 60 can be implemented as a mechanical element which operates as a developer-blocking structure without including the electrical equalization function described above with respect to other exemplary embodiments of the present invention. Alternatively, to ensure complete dissipation of any residual charge on the development roller 32, the equalizing element 60 may be charged to a suitable electric potential to remove any residual charges from the development roller even if the equalizing element 60 is performing the afore-described developer blocking function.

Figure 5:
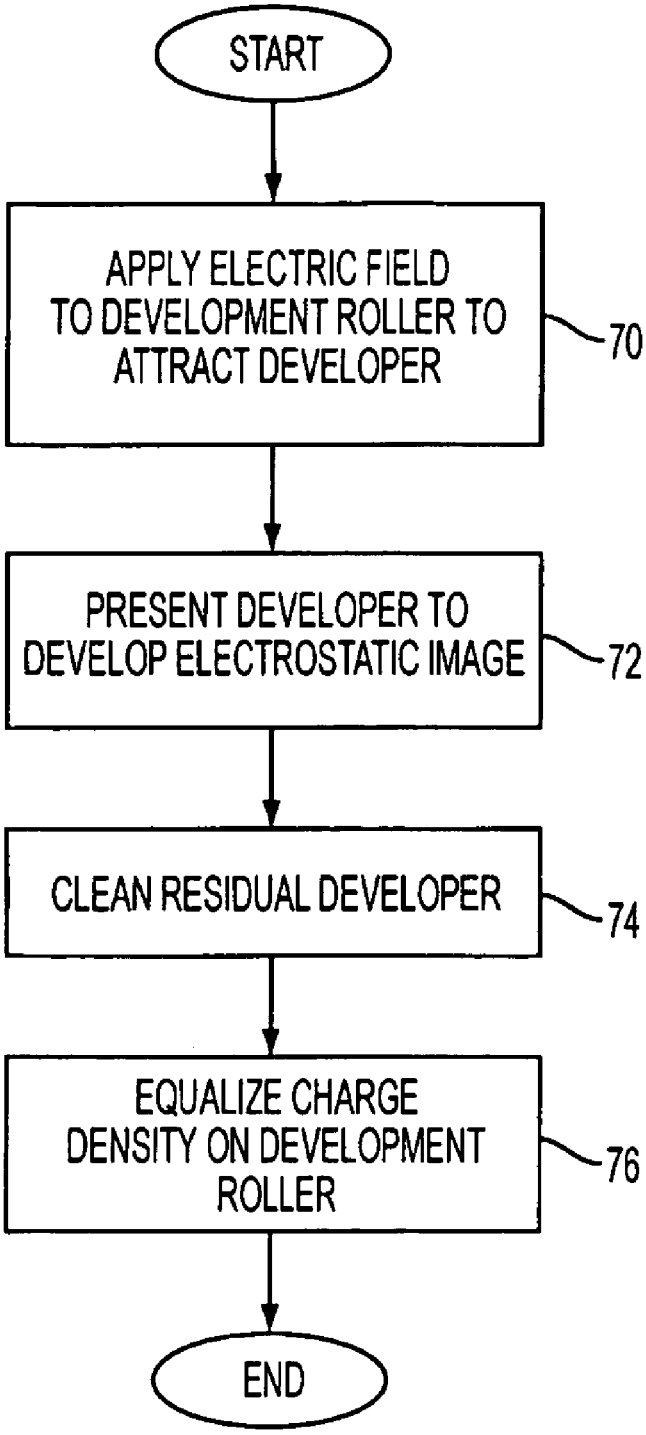
FIG. 5 is a flowchart illustrating a method for equalizing a development roller according to an exemplary embodiment of the present invention.

A method for equalizing a development roller in a printing device according to an exemplary embodiment of the present invention is shown in FIG. 5. Therein, at step 70, an electric field is applied to a development roller to attract a developer, e.g., ink or toner including conductive particles. Next, at step 72, the development roller 32 rotates such that the developer is presented in the development zone to develop the electrostatic image on, e.g., a photoreceptor surface of another roller. As the development roller 32 continues to rotate past the development zone, residual developer is cleaned by a cleaning roller 46, optionally operating in conjunction with other elements, e.g., wiper blade 48, sponge roller 50 and/or squeegee roller 52, as indicated by step 74. Residual charges which remain on the development roller 32 are then equalized at step 76 using, e.g., an element having a potential which is held at substantially the same potential as the development roller 32.

Figure 6:
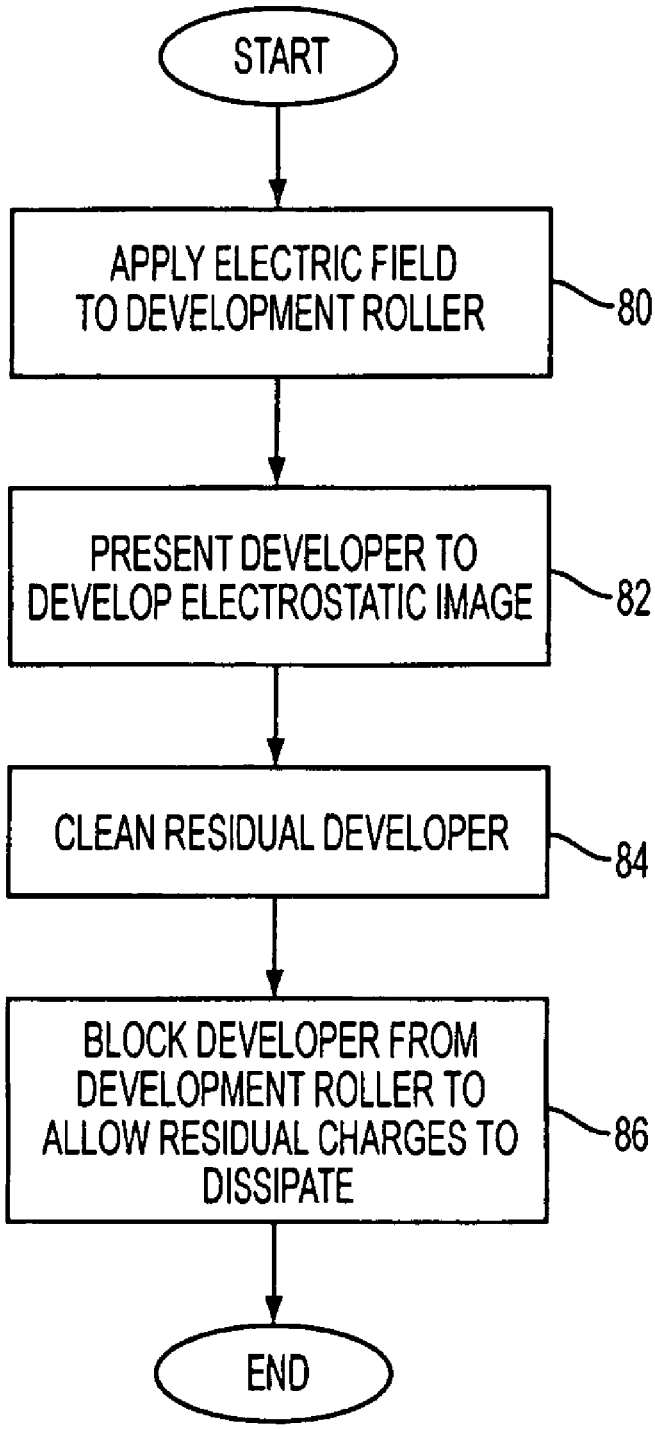
FIG. 6 is a flowchart illustrating another method for equalizing a development roller according to an exemplary embodiment of the present invention.

Another method for dissipating residual charge on a development roller in a printing device according to an exemplary embodiment of the present invention is shown in FIG. 6. Therein, at step 80, an electric field is applied to a development roller to attract a developer, e.g., ink or toner including conductive particles. Next, at step 82, the development roller 32 rotates such that the developer is presented in the development zone to develop the electrostatic image on, e.g., a photoreceptor surface of another roller. As the development roller 32 continues to rotate past the development zone, residual developer is cleaned by a cleaning roller 46, optionally operating in conjunction with other elements, e.g., wiper blade 48, sponge roller 50 and/or squeegee roller 52, as indicated by step 84. Residual charges which remain on the development roller 32 are then dissipated during the movement of the development roller 32 from the cleaning zone to the imaging device 14 by substantially blocking developer from the development roller 32 in this region as indicated by step 86.

The foregoing description of exemplary embodiments of the present invention provides illustration and description, but it is not intended to be exhaustive or to limit the invention to the precise form disclosed. Modifications-and variations are possible in light of the above teachings or may be acquired from practice of the invention. The following claims and their equivalents define the scope of the invention.

The invention claimed is:

1. A method for minimizing residual charge effects in a printing device comprising the steps of:

applying an electric potential to a development roller to attract developer to said development roller;

rotating said development roller in a development zone of said printing device to form an image;

cleaning residual developer from said development roller after said development roller has passed said development zone by contacting a cleaning roller to said development roller, said cleaning roller being charged with an electric potential which is different than that of said development roller, such that said residual developer is attracted to said cleaning roller by electrophoresis; and equalizing a charge density on said development roller after said cleaning with an equalizing element that substantially blocks the developer.

2. The method of claim 1, wherein said developer is an ink or toner having conductive particles therein.

3. The method of claim 1, wherein said step of equalizing further comprises the step of:

contacting a conductive element to said development roller, wherein said conductive element has an electric potential which is substantially equal to that of said development roller, to generate a substantially uniform charge density across a surface of said development roller.

4. The method of claim 3, wherein said conductive element is one of a roller and a blade.

5. The method of claim 1, wherein said step of equalizing further comprises the step of:

providing a conductive element in close proximity to said development roller, wherein said conductive element has an electric potential which is substantially equal to that of said development roller, to generate a substantially uniform charge density across a surface of said development roller.

6. A printing device comprising:

a development roller having an electric potential applied thereto to attract developer to a portion of a surface of said development roller;

a cleaning roller for cleaning residual developer from said portion of said surface of said development roller after said portion of said surface of said development roller has rotated through a development zone, wherein said cleaning roller is charged with a voltage which is different than said electric potential associated with said development roller, such that said residual developer is attracted to said cleaning roller by electrophoresis; and an equalizing element for equalizing a charge density on said portion of said surface of said development roller after said portion of said surface of said development roller has rotated past said cleaning roller, wherein said equalizing element also substantially blocks the developer.

7. The device of claim 6, wherein said developer is an ink or toner having conductive particles therein.

8. The device of claim 6, wherein said equalizing element is a conductive element which is one of: proximate to and in contact with, said development roller, wherein said conductive element has an electric potential which is substantially equal to that of said development roller, to generate a substantially uniform charge density across a surface of said development roller.

9. The device of claim 8, wherein said conductive element is one of a roller and a blade.

10. A system for minimizing residual charge effects in a printing device comprising:

means for applying an electric potential to a development roller to attract developer to said development roller;

means for rotating said development roller in a development zone of said printing device to form an image;

means for cleaning residual developer from said development roller after said development roller has passed said development zone, wherein a cleaning roller is charged with a voltage which is different than said electric potential associated with said development roller, such that said residual developer is attracted to said cleaning roller by electrophoresis; and means, disposed downstream of said cleaning means, for equalizing a charge density on said development roller and for substantially blocking the developer.

11. A method for minimizing residual charge effects in a printing device comprising the steps of:

applying an electric potential to a development roller to attract developer to said development roller;

rotating said development roller in a development zone of said printing device to form an image;

cleaning residual developer from said development roller after said development roller has passed said development zone and entered a cleaning zone;

equalizing a charge density on said development roller after said cleaning; and substantially blocking said developer from reaching said development roller downstream of said cleaning roller.

12. The method of claim 11, wherein the step of substantially blocking said developer from reaching said development roller of said cleaning roller is implemented by a mechanical element which has no voltage directly applied to said mechanical element.

13. A printing device comprising:

a development roller having an electric potential applied thereto to attract developer to a portion of a surface of said development roller;

a cleaning roller for cleaning residual developer from said portion of said surface of said development roller after said portion of said surface of said development roller has rotated through a development zone;

an equalizing element for equalizing a charge density on said development roller after said cleaning; and a blocking element for substantially blocking said developer from said development roller downstream of said cleaning roller.

14. The printing device of claim 13, wherein said blocking element is a mechanical element which has no voltage directly applied to said mechanical element.

15. A method for minimizing residual charge effects in a printing device comprising the steps of:

applying an electric potential to a development roller to attract developer to said development roller;

rotating said development roller in a development zone of said printing device to form an image;

cleaning residual developer from said development roller after said development roller has passed said development zone by contacting a cleaning roller to said development roller, said cleaning roller being charged with an electric potential which is different than that of said development roller, such that said residual developer is attracted to said cleaning roller by electrophoresis; and equalizing a charge density on said development roller after said cleaning by contacting a conductive element to said development roller, wherein said conductive element has an electric potential which is substantially equal to that of said development roller, to generate a substantially uniform charge density across a surface of said development roller; disposing said conductive element at a location downstream of said cleaning roller to block introduction of said developer into a cleaning nip between said development roller and said cleaning roller.

16. The method of claim 15, wherein said developer is an ink or toner having conductive particles therein.

17. The method of claim 15, wherein said conductive element is one of a roller and a blade.

18. The method of claim 15, wherein said step of equalizing further comprises the step of:

providing a conductive element in close proximity to said development roller.

19. A printing device comprising:

a development roller having an electric potential applied thereto to attract developer to a portion of a surface of said development roller;

a cleaning roller for cleaning residual developer from said portion of said surface of said development roller after said portion of said surface of said development roller has rotated through a development zone, wherein said cleaning roller is charged with a voltage which is different than said electric potential associated with said development roller, such that said residual developer is attracted to said cleaning roller by electrophoresis; and an equalizing element for equalizing a charge density on said portion of said surface of said development roller after said portion of said surface of said development roller has rotated past said cleaning roller, wherein said equalizing element is disposed at a location downstream of said cleaning roller to block substantial introduction of developer into a cleaning zone.

20. The device of claim 19, wherein said developer is an ink or toner having conductive particles therein.

21. The device of claim 19, wherein said equalizing element is a conductive element which is one of: proximate to and in contact with, said development roller, wherein said conductive element has an electric potential which is substantially equal to that of said development roller, to generate a substantially uniform charge density across a surface of said development roller.

22. The device of claim 21, wherein said conductive element is one of a roller and a blade.

* * * * *